United States Patent [19]

Targa et al.

[11] Patent Number: 4,640,087

[45] Date of Patent: Feb. 3, 1987

[54] ROPE-MAKING MACHINE

[76] Inventors: Giorgio Targa, Via S. Giovanni Battista alla Creta, 2; Vitaliano Russo, Via P. Litta, 2, both of Milan, Italy

[21] Appl. No.: 634,032

[22] Filed: Jul. 24, 1984

[30] Foreign Application Priority Data

Jul. 26, 1983 [IT] Italy ..... 22234 A/83
Feb. 21, 1984 [IT] Italy ..... 19722 A/84

[51] Int. Cl.[4] ..... D07B 3/04

[52] U.S. Cl. ..... 57/58.36; 57/58.34; 57/58.38

[58] Field of Search ..... 57/58.3–58.38, 57/127.5, 127.7

[56] References Cited

U.S. PATENT DOCUMENTS

| | | | |
|---|---|---|---|
| 2,162,131 | 6/1939 | Somerville | 57/59 |
| 2,690,642 | 10/1954 | Van Hook | 57/58.34 |
| 3,000,169 | 9/1961 | Richaud | 57/58.34 |
| 3,456,433 | 7/1969 | Cloostermans-Huwaert X | 57/58.34 |
| 3,557,540 | 1/1971 | Martinez | 57/58.36 X |
| 3,830,050 | 8/1974 | Ueda | 57/58.34 |
| 3,893,287 | 7/1975 | Jahne | 57/58.34 X |

FOREIGN PATENT DOCUMENTS

| | | |
|---|---|---|
| 364014 | 11/1922 | Fed. Rep. of Germany . |
| 826356 | 3/1938 | France . |
| 2087903 | 12/1971 | France . |
| 2371543 | 6/1978 | France . |
| 174604 | 1/1935 | Switzerland . |
| 653611 | 5/1951 | United Kingdom . |
| 1133711 | 11/1968 | United Kingdom . |

*Primary Examiner*—John Petrakes
*Attorney, Agent, or Firm*—Fleit, Jacobson, Cohn & Price

[57] ABSTRACT

In a rope-making machine of type having a number of reel-carrying cradles aligned along an axis and oscillating about this axis, and a number of strand guide structures supported about the cradles and coaxially with the axis, the alignment of cradles constitutes a rigid beam supported at its ends and the strand guide structures are supported along this beam.

6 Claims, 6 Drawing Figures

ROPE-MAKING MACHINE

The present invention relates to a rope-making machine of the type comprising a plurality of reel-carrying cradles aligned along an axis and oscillating about this axis, and a plurality of strand guide structures supported rotatably about the axis.

In the manufacture of ropes by a machine of this type, it is necessary to continuously unwind two or more primary strands from respective reels and bring them together, after respective guided paths, at a common winding point where the rope is made by winding of the strands.

Each of the paths stretches from the reel to the winding point along a course which is first away from and then towards the axis of the machine. This course is substantially crank-shaped with an initial section diverging from the axis of the machine, a subsequent section extending substantially in the direction of the axis and a final section which converges towards the winding point.

These crank-shaped paths of the various primary strands lie in respective planes arranged star-like about the axis of the machine, and they have to be rotated so that the strands twist continuously at the winding point to form the required rope.

In these crank-shaped paths, then, the section which extends in the direction of the axis is substantially as long as is necessary to cover the distance between the reel from which the primary strand unwinds and the winding point, this section passing the strand over all the reel-carrying cradles lying between the reel from which the strand is unwound and the winding point.

Now then, in order to fulfil this requirement, the strand guide structures of known rope-making machines of the aforesaid type currently in use comprise tubular bodies which are coaxial with the axis of the machine and supported rotatably by bearings, and within which the reel-carrying cradles are supported for rotation.

The strands which are unwound gradually from the reels run along paths lying on the tubular bodies to emerge from a tubular body at the end and converge at the winding point.

These tubular bodies are rotated so as to effect the twisting of the strands at the winding point.

These commonly-termed tubular rope-making machines, while advantageous from various aspects and substantially fulfilling their purpose, do nevertheless have some recognised disadvantages arising from the fact that in such machines there are two circumstances which are difficult to reconcile, these being the large dimensions of the tubular bodies and their high speed of rotation.

In machines of this type, therefore, the bearings which support the tubular bodies have difficult operating conditions, since the bodies are of large dimensions and have to rotate at high speeds. Moreover, the weight of the tubular bodies is a serious risk factor in the event of an accident.

A reduction of the diameters of the tubular bodies to correspond with the opposing ends of the reel-carrying cradles, with a resultant decrease in the diameter of the bearings, has been proposed. This did effect an improvement in the operating conditions of the bearings, but made the path of strands in its section parallel to the axis of the machine tortuous owing to the need to pass the gradual constrictions created locally by the decreased diameter of the bearings.

It has also been suggested that, in order to avoid local tortuosity, the strand should be made to follow a substantially sinusoidal path, crossing the axis of the machine every time it encounters one of the constrictions.

In this case, the tubular bodies could be reduced to guide arcs for the strands. These rope-making machines are known as arc machines and are known commercially under the name SKIP.

The path of the strand will thus be smoother but no less tortuous. Two main disadvantages result from this, and are particularly noticeable when the primary strands to be twisted are numerous.

A first disadvantage results from the fact that the numerous deviations in the path taken by the strands slow down the strands and adversely affect the quality of the rope.

A second disadvantage results from the fact that the simultaneous passage of several strands close to the axis of the machine may cause them to rub together, with possible damage if, for example, the primary strands are coated. Moreover, the adoption of protection for individual strands, in order to prevent them rubbing together close to the axis of the machine, is troublesome and involves constructional complications.

The problem behind the present invention is that of devising a rope-making machine of the aforesaid type, which will have structural and operational characteristics such as to meet the aforesaid requirement, while at the same time overcoming the disadvantages cited with reference to the rope-making machines of the prior art.

The concept on which this invention is based is that of separating the two functions of supporting the reels of primary strands being unwound and of guiding the primary strands along paths between the respective reels and the winding point.

Based upon this idea to solve and resolve the said technical problem, the present invention provides a rope-making machine of the aforesaid type as characterised in the claims.

Advantageously, and in the case in which the rope-making machine is of the type including a plurality of reel-carrying cradles aligned along one axis and having at their ends respective pins by which they oscillate about the axis, and a plurality of strand guide structures supported rotatably about the cradles coaxially with the axis, the present invention provides a rope-making machine as characterised in the second claim.

Advantageously, and in the case in which the rope-making machine is of the type including a plurality of reel-carrying cradles aligned along an axis and having at their ends respective bushes by which they oscillate about the axis, and a plurality of mutually-aligned tubular strand guide structures, supported rotatably about the cradles and coaxially with the axis, the present invention provides a rope-making machine as characterised in the fourth claim.

Further characteristics and advantages of the rope-making machine according to this invention will be apparent from the following description of a preferred embodiment given, by way of non-limiting example, with reference to the accompanying drawings, in which.

Figure 1:
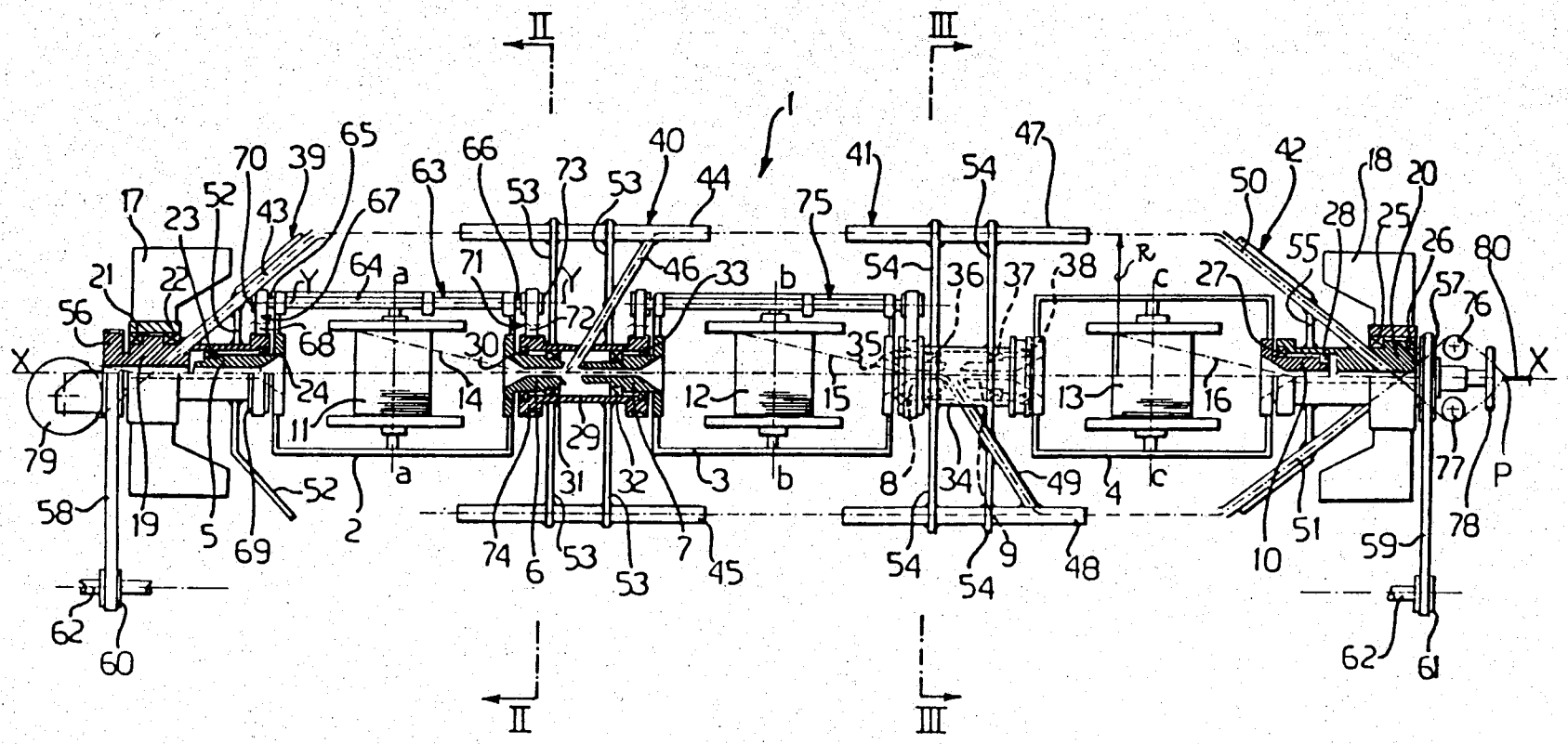
FIG. 1 is a partially-sectioned plan view of a rope-making machine according to the invention.
Figure 3:
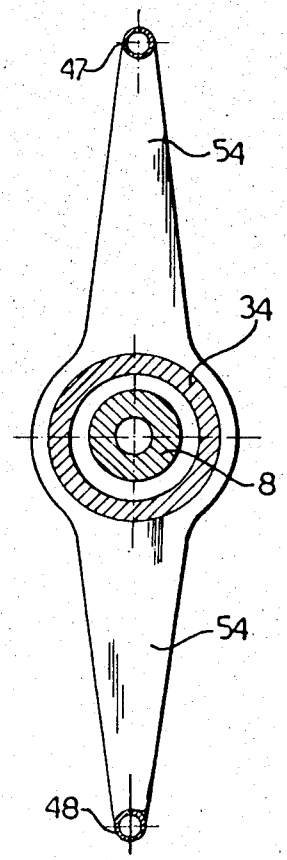
FIG. 3 is a sectional view of the machine in FIG. 1 on an enlarged scale, taken along the line III—III.
Figure 2:
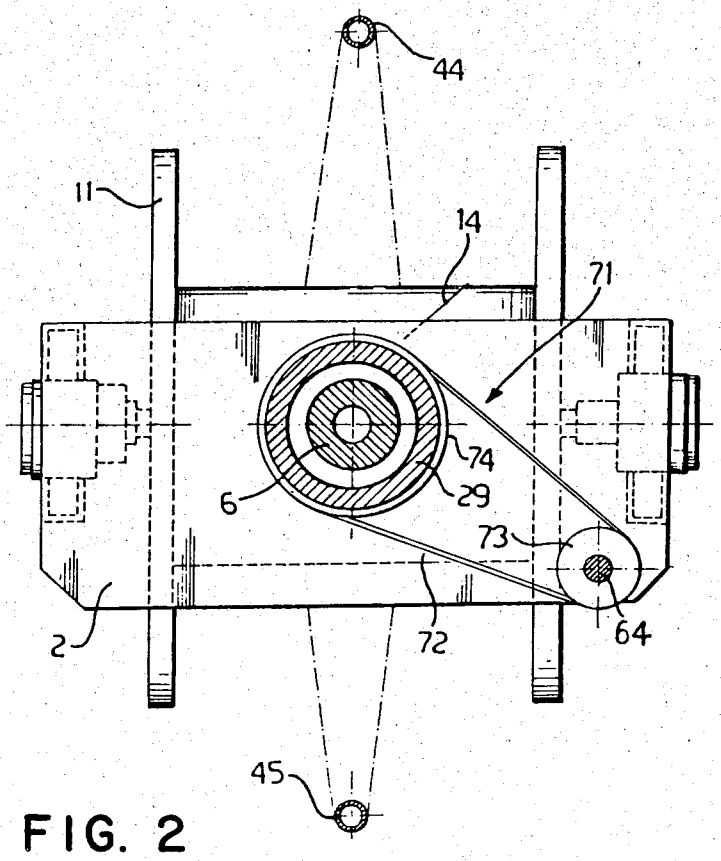
FIG. 2 is a section view of the machine in FIG. 1 on an enlarged scale, taken along the line II—II.

Referring to the accompanying drawings, a rope-making machine according to the invention is generally indicated 1.

The rope-making machine 1 includes a plurality of reel-carrying cradles, three in the example described, indicated 2, 3, 4 respectively.

The cradles 2, 3, 4 are aligned along a horizontal axis X—X; more particularly, the cradles 2, 4 are the end cradles in the alignment.

At their ends, the cradles 2, 3, 4 have respective hollow pins 5–10 by means of which the cradles 2, 3, 4 oscillate about the said axis.

More particularly, the pins of the cradle 2 are indicated as 5, 6, those of the cradle 3 as 7, 8 and those of the cradle 4 as 9, 10. The pins 5 and 10 are the outer pins of the end cradles 2, 4 respectively, while the pins 6, 7 and the pins 8, 9 form respective pairs of intermediate pins between the adjacent cradles 2, 3 and 3, 4 respectively.

The pins 6, 7 and the pins 8, 9 are arranged end-to-end and are mutually spaced-apart by a small amount.

In each cradle 2, 3, 4 is rotatably and removably mounted a respective reel 11, 12, 13 having a respective primary strand 14, 15, 16 wound around it. Clearly, each primary strand can consist of a bare or coated single fibre of round or other cross-section, a rope, a strand per se, a plait, a small tube, or combinations of these.

The reels 11, 12, 13 have respective horizontal axes a—a, b—b, c—c directed perpendicular to the axis X—X.

At the end of the alignment of cradles, the machine 1 includes respective fixed stands 17, 18 attached to a common base with which the machine 1 is provided, not shown in the drawings.

The outer pins 5, 10 are attached rotatably to the fixed stands 17, 18 respectively, with the interposition of respective hubs 19, 20 rotatably supported in their turn by the stands.

The hub 19 is rotatably supported in the stand 17 by rolling bearings 21, 22 located at a predetermined distance apart, while the pin 5 is fixed rotatably within the hub 19 by rolling bearings 23, 24.

It should be pointed out that the above-mentioned bearings may be of the hydrodynamic type, or they may provide hydrostatic, pneumostatic or electro-dynamic support.

Similarly, the hub 20 is supported rotatably in the stand 18 by rolling bearings 25, 26 located at a predetermined distance apart, while the pin 10 is fixed rotatably within the hub 20 by bearings 27, 28.

A hub 29 is mounted rotatably on the pair of intermediate pins 6, 7.

More particularly, the hub 29 is mounted on the pin 6 by two rolling bearings 30, 31 and on the pin 7 by two rolling bearings 32, 33.

In exactly the same way, a hub 34 is mounted rotatably on the intermediate pins 8, 9.

More particularly, the hub 34 is mounted on the pin 8 by rolling bearings 35, 36 and on the pin 9 by rolling bearings 37, 38.

The bearings of each pair of bearings 30–31, 32–33, 35–36 and 37–38 are spaced-apart by a predetermined distance.

Thus, the cradles in the alignment are fixed rigidly together in pairs coaxially, and the whole alignment of cradles thus forms a rigid beam with an axis X—X, supported at the ends by the fixed stands.

The machine 1 further includes a number of strand guide structures, four in number in the example illustrated and indicated 39, 40, 41, 42 in the drawings, which are supported rotatably about the cradles 2, 3, 4 coaxial with the axis X—X.

The strand guide structure 39 comprises a tube 43 forming an angle with the axis X—X.

The strand guide 40 comprises two tubes 44, 45 extending parallel to the axis X—X on opposite sides thereof and at a distance R therefrom, and a tube 46 forming an angle with the axis X—X, the tube 46 having one end which leads to the axis X—X between the pins 6, 7 and an opposite end which leads into the tube 44.

The strand guide structure 41, which is substantially identical to the strand guide 40, comprises two tubes 47, 48 parallel to the axis X—X and a tube 49 forming an angle with the axis X—X.

Finally, the strand guide structure 42 comprises two tubes 50, 51 forming an angle with the axis X—X.

The tube 43 of the strand guide structure 39 has one end leading into the hub 19 and an opposite end leading to the exterior at a distance from the axis X—X equal to R.

The tubes 50, 51 of the strand guide structure 42 have one end leading into the hub 20 and opposite ends leading to the exterior at a distance from the axis X—X equal to R.

In the machine 1 according to the invention, the hubs 19, 20, 29, 34 are fixed for rotation with the respective strand guide structures 39, 40, 41, 42 which they support.

For this purpose, the hubs 19, 20, 21, 22 are provided with spokes which connect them with the respective strand guide structures 39, 40, 41, 42.

More particularly, the spokes connecting the hub 19 to the strand guide structure 39 are indicated 52, the spokes connecting the hub 29 to the strand guide structure 40 are indicated 53, those connecting the hub 34 to the strand guide structure 41 are indicated 54, and finally those connecting the hub 20 to the strand guide structure 42 are indicated 55.

It should be pointed out that, according to a variant of the embodiment, the strand guide structures 39, 40, 41, 42 can be formed as respective portions of thin tubing made from carbon-fibre-reinforced epoxy resin, along the generatrices of which are fixed staples for guiding the primary strands. This variant is advantageous from the point of view of air resistance.

In the machine 1, the strand guide structures 39, 40, 41, 42 are rotated about the axis X—X at the same angular velocity by the respective hubs 19, 20, 29, 34. For this purpose, the hubs 19, 20 are fitted with respective identical toothed pulleys 56, 57 upon which are wound respective toothed pulleys 60, 61 keyed onto a common shaft 62 supported by the base of the machine and rotated by motor means, not shown.

The hub 29 is rotated by the hub 19 through a kinematic mechanism, generally indicated 63, described in detail below.

The kinematic mechanism 63 includes a shaft 64, with an axis Y—Y extending parallel to the axis X—X, which is freely-rotatably mounted on the cradle 2 and has opposite cantilevered ends 65, 66 projecting from the cradle 2 to the hubs 19, 29 respectively. The kinematic mechanism 63 also includes a first transmission 67 with a toothed belt 68 and toothed pulleys 69, 70, which connects the hub 19 and the shaft 64 together for rotation, and a second transmission 71 with a toothed belt 72 and pulleys 73, 74 exactly the same as the transmission 67, which connects the hub 29 and the shaft 64 together for rotation.

The hub 34 is rotated in its turn by the hub 39 through a kinematic mechanism 75 which is exactly the same as the kinematic mechanism 63 and will therefore not be described so as not to overburden the description.

It should be pointed out that the machine 1 is pre-adapted for receiving another kinematic mechanism identical to the kinematic mechanism 63, 75 for rotatably connecting the hub 20 to the hub 34.

In this case, the transmission formed by the belt 59 and the pulleys 57, 51 described above may be deactivated.

It should be pointed out that the strand guide structures 39, 40, 41, 42 can, according to a variant of the embodiment, form a structurally unitary body so as to be fixed for rotation. This variant is advantageous in that it renders superfluous the kinematic mechanisms for rotatably connecting the strand guide structures.

The machine 1 according to the invention further includes a pair of small-diameter pulleys 76, 77 freely-rotatably supported by the hub 20 externally of the fixed stand 18, and lying in a plane which passes through the axis X—X on opposite sides thereof. A strand guide disc 78 is located at the end of the hub 20 outwardly of the pulleys 76, 77 and perpendicular to the axis X—X.

The machine 1 also includes a large-diameter pulley 79 freely rotatably supported by the hub 19 outwardly of the fixed stand 17. The pulley 79 lies in a plane which passes through the axis X—X.

There follows a description of the paths the strands 14, 15, 16 are caused to follow in a preferred mode of use of the machine 1. These paths are indicated by chain lines in the drawings.

The strand 14, being unwound continuously from the reel 11, passes through the hollow pin 6, enters and passes through the tube 46 of the strand guide structure 40 thereby moving away from the axis X—X, passes through the tube 44 of the strand guide structure 40, then enters and runs through the tube 47 of the strand guide structure 41, remaining parallel to the axis X—X. It then enters and passes through the tube 50 of the strand guide structure 42 to converge on the axis X—X. At this point, it crosses the axis X—X, passes around the pulley 77 to return towards the axis X—X and, traversing the strand guide disc 78, reaches a point on the axis X—X indicated P in the drawing, commonly called the winding point.

The thread 15, being unwound continuously from the reel 12, passes through the hollow pin 8, the tube 49 of the strand guide structure 41, the tube 48 of the same strand guide structure 41, the tube 51 of the strand guide structure 42, passes through the hub 20 and around the pulley 76, traverses the disc 78, and converges in its turn on the winding point P.

The thread 16, however, is unwound continuously from the reel 13 and reaches the point P directly along the axis X—X by passing through the pin 10 and the hub 20.

The rotation of strand guide structures 39, 40, 41, 42 causes the paths of the strands 14, 15 to rotate in a substantially crank-like fashion, thereby inducing the desired twisting of these strands about the strand 16 at the point P and hence producing a continuous three-strand rope 80.

According to another advantageous mode of use of the machine 1 according to the invention, the strand 14 is made to follow the path described below: it is unwound continuously from the reel 11, passes through the pin 5 and the hub 19, passes around the pulley 79, passes through the hub 19 again, enters and passes through the tube 43, the tubes 44, 47, and then the tube 50; it then passes through the hub 20, passes around the pulley 77, traverses the disc 78, and finally converges on the point P.

In the machine 1 according to the invention, the intermediate hubs and the fixed stands at the ends serve to support the reel-carrying cradles, while the strand guide structures serve only to guide the primary strands along their paths from the unwinding reels to the winding point.

Figure 4:
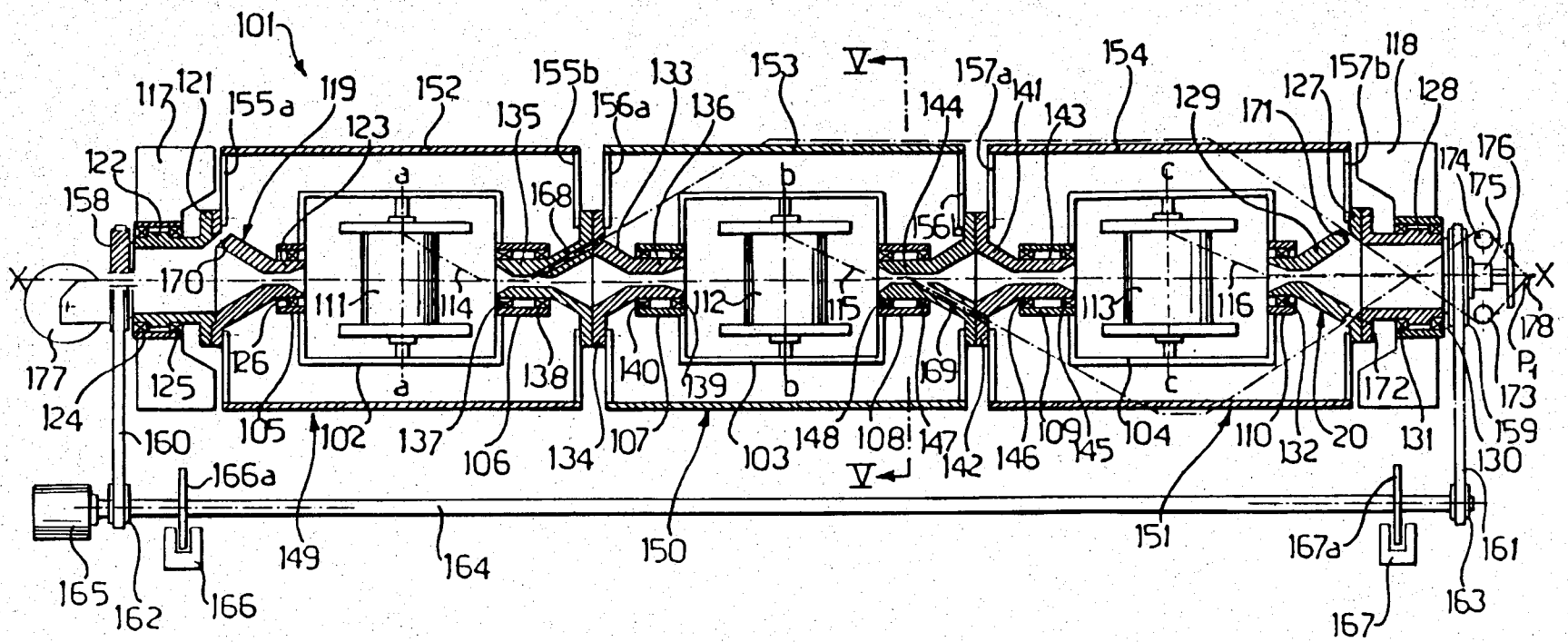
FIG. 4 is a partially-sectioned plan view of another example of a rope-making machine according to the invention, used with so-called normal strands.
Figure 5:
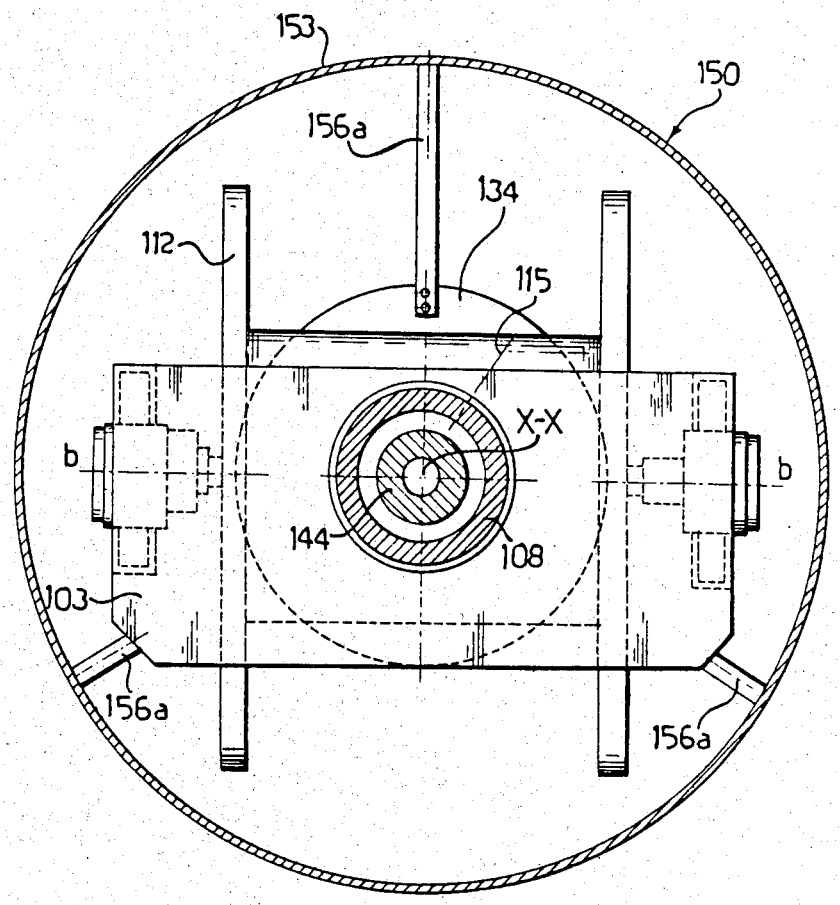
FIG. 5 is a sectional view of the machine in FIG. 4 on an enlarged scale, taken along the line V—V.
Figure 6:
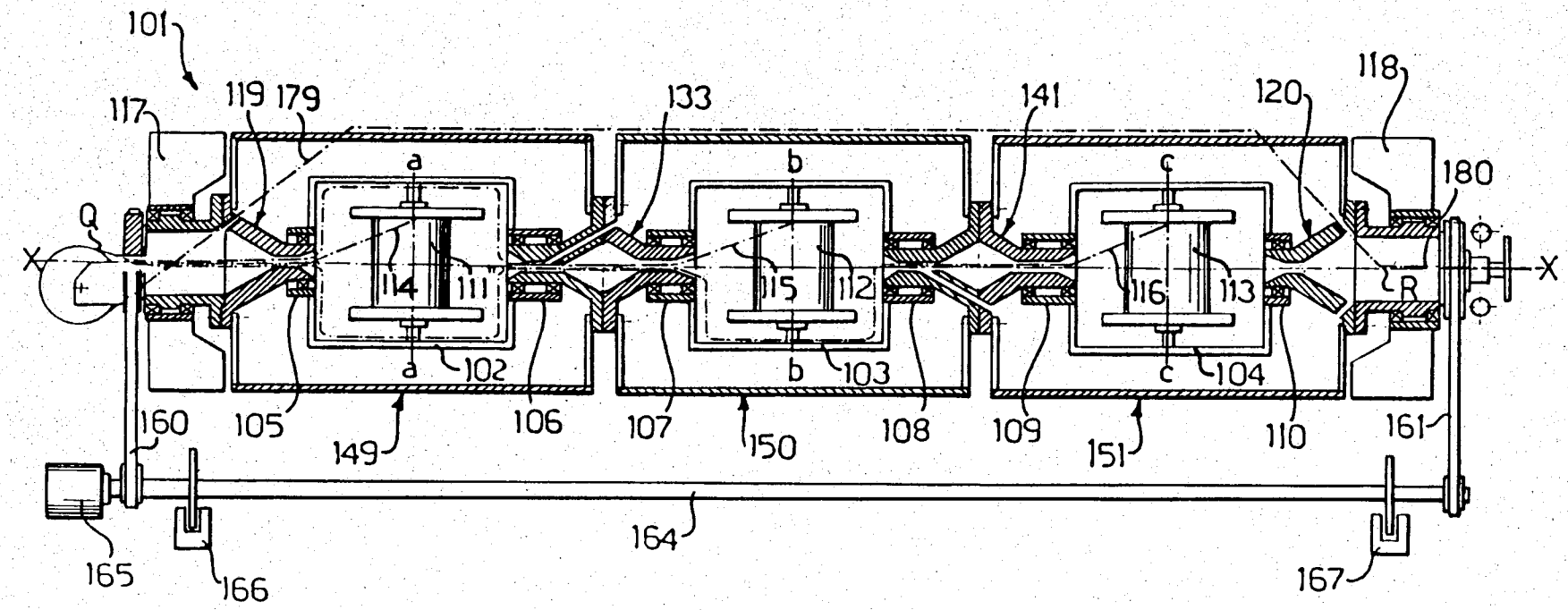
FIG. 6 is a partially-sectioned plan view of the machine of FIG. 4 used with double-twist strands.

With reference to FIGS. 4, 5 and 6, another example of a rope-making machine according to the invention is generally indicated 101.

The rope-making machine 101 includes a plurality of reel-carrying cradles, three in the example described, indicated 102, 103, 104 respectively.

The cradles 102, 103, 104 are aligned along a horizontal axis X—X; more particularly, the cradles 102, 104 are the end cradles of the alignment.

At their ends, the cradles 102, 103, 104 have respective bushes 105–110 by means of which the cradles 102, 103, 104 oscillate about the said axis.

More particularly, the bushes of the cradle 102 are indicated 105, 106, those of the cradle 103 as 107, 108 and those of the cradle 104 as 109, 110. The bushes 105, 110 are the outer bushes of the end cradles 102, 104 respectively, while the bushes 106, 107 and the bushes 108, 109 form respective pairs of intermediate bushes between the adjacent cradles 102, 103, 104 respectively.

The bushes 106, 107 and the bushes 108, 109 are arranged end-to-end and are mutually spaced apart by a small amount.

In each cradle 102, 103, 104 is rotatably and removably mounted a respective reel 111, 112, 113 having a respective primary strand 114, 115, 116 wound around it.

The reels 111, 112, 113 have respective horizontal axes a—a, b—b, c—c directed perpendicular to the axis X—X.

At the ends of alignment of the cradles, the machine 101 includes respective fixed stands 117, 118 attached to a common base of the machine 101, not shown in the drawings.

The outer bushes 105, 110 are supported rotatably by the fixed stands 117, 118 respectively, with the interposition of respective hollow pins 119, 120 rotatably supported in their turn by the fixed stands 117, 118.

More particularly, the hollow pin 119 has a central portion 121 and opposite end portions 122, 123. The end portion 122 has a predetermined length and is rotatably supported in the fixed stand 117 by two rolling bearings 124, 125 located a predetermined distance apart. A bush 105 is rotatably mounted on the end portion 123 by means of a rolling bearing 126.

Similarly, the hollow pin 120 has a central portion 127 and opposite end portions 128, 129. The end portion 128 has a predetermined length and is rotatably supported in the fixed stand 118 by means of two rolling bearings 130, 131 located a predetermined distance apart.

A bush 110 is rotatably mounted on the end portion 129 by means of a rolling bearing 122.

A length of hollow shaft, indicated 135, is interposed coaxially between the cradles 102, 103.

More particularly, the length of shaft 133 has a central portion 134 and opposite end portions 135, 136 of predetermined length. The bush 106 of the cradle 102 is rotatably mounted on the end portion 135 by means of two rolling bearings 137, 138 located a predetermined distance apart, while the bush 107 of the cradle 103 is rotatably mounted on the end portion 136 by means of two rolling bearings 139, 140 also located a predetermined distance apart.

In an entirely similar manner, a length of hollow shaft, indicated 141, is interposed coaxially between the cradles 103, 104.

More particularly, the length of shaft 141 has a central portion 142 and opposite end portions 143, 144 of predetermined length. The bush 109 of the cradle 104 is rotatably mounted on the end portion 143 by means of two rolling bearings 145, 146 located a predetermined distance apart, while the bush 108 of the cradle 103 is rotatably mounted on the end portion 144 by means of two rolling bearings 147, 148 also located a predetermined distance apart.

Thus, the cradles 102, 103, 104 of the alignment of cradles are fixed rigidly together in pairs coaxially, and the entire alignment of cradles thus forms a rigid beam with an axis X—X, supported at the ends by the fixed stands.

The machine 101 further includes a plurality of tubular strand guide structures, three in the example illustrated and indicated 149, 150, 151 in the drawings, which are supported rotatably about the cradles 102, 103, 104 coaxially with the axis X—X in the manner described below.

In the example illustrated, the strand guide structures 149, 150, 151 comprise respective portions of thin tubing, indicated 152, 153, 154, made preferably but not necessarily from carbon-fibre-reinforced epoxy resin, along the generatrices of which are fixed staples for guiding the primary strands.

The tube portion 152 of the strand guide structure 149 is positioned around the cradle 102 and extends from the central portion 121 of the pin 119 to the central portion 134 of the length of shaft 133: the ends of the tube portion 152 are firmly connected to these central portions 131, 134 by means of respective pluralities of radial spokes, indicated 155*a*, 155*b* respectively.

In exactly the same way, the tube portion 154 of the strand guide structure 151 is positioned around the cradle 104 and extends axially from the central portion 127 of the pin 120 to the central portion 142 of the length of shaft 141: the ends of the tube portion 154 are firmly connected to these central portions 127, 142 by means of respective pluralities of radial spokes, indicated 157*a*, 157*b* respectively.

Regarding the tube portion 152 of the strand guide structure 149, this is positioned around the cradle 103 and extends axially between the central portions 134, 142 of the lengths of shaft 133, 141: the ends of the tube portion 152 are firmly connected to these central portions 134, 142 by means of respective pluralities of radial spokes, indicated 156*a*, 156*b* respectively.

In the machine 101, the strand guide structures 149, 150, 151 are all rotated about the axis X—X at the same angular velocity, in the manner described below.

To the free ends of the end portions 122, 128 of the pins 119, 120 are keyed respective identical toothed pulleys 158, 159 which are connected by respective toothed belts 160, 161 to respective identical pulleys 162, 163 keyed onto a common shaft 164 which is rotatably supported by the base of the machine 101 and is subject to the action of motor means, generally indicated 165.

The pins 119, 120 are thus rotated in accordance with the rotation of the motor means 165 and, in their turn, they rotate respectively the strand guide structures 149, 151 by means of the respective radial spokes 155*a*, 155*b*.

In their turn, the strand guide structures 149, 151 rotate respectively the lengths of shaft 133, 141 by means of the respective radial spokes 155*b*, 157*a*.

The spokes of both shafts 133, 141 rotate the strand guide structure 150 in their turn, by means of the spokes 156*a*, 156*b* respectively.

Two disc brakes, indicated 166 and 167, are placed close to the pulleys 162, 163 and act on respective discs 166*a*, 167*a* keyed to the shaft 164 to stop the strand guide structures as required.

It should be pointed out that the thin tube portions 152, 153, 154 of the strand guide structures 149, 150, 151 can, in a variant of the embodiment, form a structurally unitary body so as to be per se fixed in rotation independently of the presence of the spokes 155*b*, 156*a*, 156*b*, 157*a*.

The length of shaft 133 has a through-hole 168 which opens from its central portion 134 and forms an angle with the axis X—X.

Similarly, the length of shaft 141 has a through-hole 169 which opens from its central portion 142 and also forms an angle with the axis X—X.

The central portion 121 of the pin 119 has one through-hole 170 forming an angle with the axis X—X, while the centre portion 127 of the pin 120 has two through-holes 171, 172 also forming angles with the axis X—X.

The machine 101 according to the invention also includes a trio of small-diameter pulleys 173, 174, 175 which are freely-rotatably mounted on the free end of the end portion 128 of the pin 120 outwardly of the fixed stand 118, and all lie in respective half planes passing through the axis X—X and disposed at 120° to one another. A strand guide disc 176 is located at the end of the pin 120, perpendicularly to the axis X—X and externally of the pulleys 173, 174, 175.

The machine 1 further includes a large-diameter pulley 177 which is rotatably mounted at the free end of the end portion 122 of the pin 119 outside the fixed stand 117.

The pulley 177 lies on a plane which passes through the axis X—X and is substantially tangential to this axis X—X.

With reference to FIG. 4, there follows a description of the paths the strands 114, 115, 116 are caused to follow according to one mode of use of the machine 101, that is, with so-called normal strands.

The paths followed by the strands are indicated by chain lines in the drawing.

The strand 114, being continuously unwound from the reel 115, enters the length of shaft 133, passes through the through-hole 168, and reaches the thin tube portion 153 of the strand guide structure 150, thereby diverging from the axis X—X; at this point, it passes over the tube portion 153 along one of its generatrices parallel to the axis X—X, and passes over the tube portion 154 of the strand guide structure 151 along a section of one of its generatrices.

It then leaves it to pass through the through-hole 171 in the pin 120, thereby approaching the axis X—X. At this point, it crosses the axis X—X and passes around the pulley 173 to return towards the axis X—X and, traversing the strand guide disc 176, reaches a point on the axis X—X indicated $P_1$, commonly called the winding point.

The strand 115 is continuously unwound from the reel 112, enters the length of shaft 141, passes through the through-hole 169, and reaches the tube portion 154 of the strand guide structure 151, thereby diverging from the axis X—X.

At this point, it runs over the tube portion 154 parallel to the axis X—X, along one of its generatrices.

It then leaves it to pass through the through-hole 172 of the pin 120 and approach the axis X—X. It crosses the axis, passes around the pulley 174 to return towards the axis X—X and, traversing the disc 176, converges in its turn on the winding point $P_1$.

The strand 116, being unwound continuously from the reel 113, enters the pin 120, moves away from the axis X—X to pass around the pulley 175, then returns towards the axis X—X, traverses the disc 176, and converges in its turn on the winding point $P_1$.

The rotation of the strand guide structures 149, 150, 151 causes the rotation of the paths of the strands 114, 115, 116, which are all substantially crank-shaped, thereby inducing the desired twisting of the strands at the point P and hence continuously producing a three-strand rope 178 downstream of the point P.

Referring to FIG. 6, there is described below another advantageous mode of use of the machine 101 according to the invention, that is, with so-called double-twist strands.

The paths which the strands 114, 115, 116 are made to follow are shown by chain lines in the drawing.

The strand 114 is unwound continuously from the reel 111 to enter the pin 119 and pass through it along the axis X—X; it reaches the pulley 177 at a point indicated at Q and passes around it for almost an entire turn.

It then leaves the pulley 178 to approach the axis X—X, crosses this axis X—X, passes through the through hole 170 of the pin 119, and reaches the tube portion 152 of the strand guide structure 149.

It passes over a section of the latter to the axis X—X along one of its generatrices, passes on to the tube portion 153 of the strand guide structure 150, runs over the whole length thereof, and passes onto the tube portion 154 of the strand-guide structure 151. It runs over a section thereof, leaves it and, moving towards the axis X—X, passes through the through-hole 171 of the pin 120. Having reached the axis X—X at a point indicated as R, it continues along the axis through the pin 120.

The strand 15, being unwound continuously from the reel 112, is made to pass along the axis X—X through the length of shaft 133, is taken along a guided path through the cradle 133, and is then made to pass through the pin 119, along the axis X—X, until it joins the strand 114 at the point Q.

It then follows the same path as the strand 14.

The strand 116 is unwound continuously from the reel 113 and runs successively through the length of shaft 141, the cradle 103, the length of shaft 133, the cradle 102, and finally the pin 119, to join the strand 114 and the strand 115 at the point Q and then follow the same common path.

A three-strand, single twisted rope 179 is formed substantially at the point Q by twisting of the strands 114, 115, 116, while a three-strand, double-twisted rope 180 is formed downstream of the point R.

In the machine 101 according to the invention, the lengths of shaft between the cradles and the fixed end strands fulfil the function of supporting the reel-carrying cradles, while the strand guide structures serve only to guide the primary strands along their paths from the unwinding reels to the winding point.

The rope-making machine according to the invention achieves the considerable advantage that the strand guide structures can be made in an unusually simple manner.

This also means that the dimensions of the rolling bearings which rotatably support the strand guide structures are unusually reduced.

By virtue of this, they can be rotated at high speed without any of the disadvantages typical of the prior-art rope-making machines described above, particularly that of danger in the event of accidents. Particularly reliable functioning can therefore be expected, even from the aspect of accident avoidance.

Moreover, in the rope-making machine according to the invention, the paths of the strands offer exactly the desired substantially crank-shaped course necessary to effect twisting without any tortuosity.

Finally, it should be pointed out that the rope-making machine according to the invention lends itself to combination with one or more similar machines. For example, for the manufacture of six-stranded ropes, two machines according to the invention, each having three reel-carrying cradles, can easily be arranged in series.

Clearly, an expert in the art will be able to make numerous modifications and variations to the rope-making machine described above in order to satisfy specific requirements, but all of these will lie within the scope of the protection for the invention defined in the following claims.

We claim:

1. A rope-making machine comprising a plurality of reel-carrying cradles aligned along an axis (X—X) and oscillating about said axis, and a plurality of first strand guide structures supported rotatably about said axis, wherein said machine further includes respective couplings which are rotatable about said axis and fix said cradles together in pairs coaxially, whereby said cradles define a rigid beam with said couplings, and a fixed stand at each end of said beam which supports a respective end of said beam free of intermediate supports, said first strand guide structures being supported by said couplings, and second strand guide structures of tubular form spaced from and parallel to said axis, said second strand guide structures supported from respective ones of said couplings.

2. A rope-making machine comprising a plurality of reel-carrying cradles aligned along an axis, respective pins at the ends of said cradles by means of which the latter oscillate about said axis, and a plurality of tubular strand guide structures rotatably supported about said cradles coaxially with said axis, wherein said machine further includes a pair of fixed stands which rotatably support the respective outer pins of the end cradles of said aligned cradles free of intermediate supports, a respective rotatable hub interposed between at least one of said outer pins and its respective stand, and respective hubs mounted rotatably on respective pairs of intermediate pins between adjacent cradles in said alignment, each hub being mounted rotatably on each of said intermediate pins by two bearings located at a predetermined distance apart, whereby said cradles and said hubs define a rigid beam, said strand guide structures being supported by said hubs.

3. A rope-making machine comprising a plurality of reel-carrying cradles aligned along an axis, respective bushes at the ends of said cradles by means of which the latter oscillate about said axis, and a plurality of mutually-aligned tubular strand guide structures supported rotatably about said cradles coaxially with said axis, wherein said machine further includes a pair of fixed stands which rotatably support the respective outer bushes of the end cradles of said alignment of cradles free of intermediate supports, a respective rotatable pin interposed between at least one of said outer bushes and its respective stand, respective lengths of shaft located between the cradles of each pair of adjacent cradles of said alignment, each length of shaft having a central portion and opposite end portions mounted rotatably in the adjacent bushes of adjacent cradles of the said alignment, each portion of a length of shaft being mounted rotatably in a respective bush by two bearings located at a predetermined distance apart, whereby said cradles and said lengths of shaft define a rigid beam, said strand guide structures being supported by said lengths of shaft.

4. A rope-making machine in accordance with claim 2 wherein said pins are hollow and define guide passages for strands.

5. A rope-making machine in accordance with claim 1 wherein said first strand guide structures extend outwardly from said axis.

6. A rope-making machine in accordance with claim 1 wherein said strand guide structures define respective linear paths for strands that pass therethrough.

* * * * *